US006988786B2

(12) United States Patent
Kaneko et al.

(10) Patent No.: US 6,988,786 B2
(45) Date of Patent: Jan. 24, 2006

(54) INK JET RECORDING HEAD AND INK DISCHARGE METHOD

(75) Inventors: Mineo Kaneko, Tokyo (JP); Ken Tsuchii, Kanagawa (JP); Keiichiro Tsukuda, Kanagawa (JP); Masaki Oikawa, Tokyo (JP); Kenji Yabe, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 30 days.

(21) Appl. No.: 10/418,218

(22) Filed: Apr. 18, 2003

(65) Prior Publication Data

US 2003/0222941 A1 Dec. 4, 2003

(30) Foreign Application Priority Data

Apr. 23, 2002 (JP) ..... 2002-121204

(51) Int. Cl.
*B41J 2/135* (2006.01)

(52) U.S. Cl. ..... 347/44; 347/54; 347/61

(58) Field of Classification Search ..... 347/44, 347/47, 48, 56, 54, 62, 61, 77
See application file for complete search history.

(56) References Cited

U.S. PATENT DOCUMENTS

| | | | | |
|---|---|---|---|---|
| 5,072,242 A | * | 12/1991 | Onhisi et al. | 347/54 |
| 5,218,376 A | | 6/1993 | Asai | |
| 5,451,989 A | | 9/1995 | Kadowaki et al. | |
| 6,062,678 A | * | 5/2000 | Ishinaga et al. | 347/48 |
| 6,139,761 A | | 10/2000 | Ohkuma | |
| 6,155,673 A | | 12/2000 | Nakajima et al. | |
| 6,174,049 B1 | | 1/2001 | Tachihara et al. | |
| 6,354,698 B1 | | 3/2002 | Tachihara et al. | |
| 6,435,661 B1 | * | 8/2002 | Inoue et al. | 347/48 |
| 6,527,367 B2 | | 3/2003 | Yabe | |
| 6,726,308 B2 | * | 4/2004 | Lee et al. | 347/48 |
| 2002/0063756 A1 | | 5/2002 | Tsuchii et al. | |

FOREIGN PATENT DOCUMENTS

| | | | |
|---|---|---|---|
| EP | 641654 A2 | * | 3/1995 |
| EP | 876916 A2 | * | 11/1998 |
| EP | 925930 A1 | * | 6/1999 |
| JP | 62-264957 | | 11/1987 |
| JP | 4-10940 | | 1/1992 |
| JP | 4-10941 | | 1/1992 |
| JP | 4-10942 | | 1/1992 |
| JP | 4-12859 | | 1/1992 |
| JP | 9-11479 | | 1/1997 |
| JP | 11-188870 | | 7/1999 |

* cited by examiner

*Primary Examiner*—Manish S. Shah
(74) *Attorney, Agent, or Firm*—Fitzpatrick, Cella, Harper & Scinto

(57) ABSTRACT

An ink jet recording head is provided with one heat generating member in each of ink flow paths, and the discharge port thereof is arranged on the extended line extending in the normal direction from the center of the main surface of the heat generating member to the surface of the substrate. Then, on the surface of the substrate, non-bubbling area is provided on the center within the projected area having the discharge port projected thereon. Bubble brought to the boil by the heat generating member pushes out ink from the discharge port by the pressure exerted by the bubble, while being communicated with the outside. With the structure thus arranged, it is made possible to enhance the precision of discharge direction of the liquid droplet discharged from the discharge port.

3 Claims, 9 Drawing Sheets

INK JET RECORDING HEAD AND INK DISCHARGE METHOD

BACKGROUND OF THE INVENTION

1. Field of the Invention

The present invention relates to an ink jet recording head for recording by discharging ink to a recording medium. The invention also relates to an ink discharge method.

2. Related Background Art

In recent years, it has become easier for an ink jet recording apparatus to obtain high-quality characters and images. The ink jet recording apparatus has been widely used as the output equipment for a computer in particular. Among such apparatuses, the one that adopts the bubble jet method, in which ink is discharged from the nozzle by means of abrupt changes of pressure exerted with quick boiling given to ink in the nozzle, makes it easier to arrange a number of nozzles in high density with a simple structure, hence becoming the main stream of the ink jet recording apparatuses.

Further, in recent years, along with the wider use of the ink jet recording apparatus, there have been more demands in a higher performance thereof, particularly in terms of the quality of recorded images, and higher speed of recording as well. In order to enhance the image quality, it is important to make the diameter of each dot to be recording on a recording medium (a recording paper sheet, in particular). The demand in such aspect is greater for the recording of images represented by photographs than the recording of written documents. For example, when a written document is recorded, the resolution needed for a beautifulness of a character or for a small character is 600 dpi to 1200 dpi, and the liquid droplet to be discharged should be good enough if it has a dot diameter of 80 to 90 $\mu$m (in terms of volume, it is approximately 30 pl). Against this, in the case of recording images, there is a need for providing a resolution of 1200 dpi to 2400 dpi in order to enable the gradation to be as smoothly represented as comparable to a silver salt photograph. When recording is made in such a resolution, it is required to use two kinds of ink having a difference of approximately ¼ to ⅙ in the densities of dye-staffs used depending on the densities of images if the dot diameter of liquid droplet to be discharged is 40 $\mu$m (in terms of volume, it is approximately 4 pl). If the dot diameter of liquid droplet to be discharged is made smaller to 20 $\mu$m (in terms of volume, it is approximately 0.5 pl), the density in the high-density portion and the smoothness in the low-density portion are made compatible with one kind of ink having a single density. As described above, in order to obtain the image quality comparable to that of a silver salt photograph, it is a prerequisite that the liquid droplet to be discharged is made smaller.

As the known methods for discharging small ink droplets stably, it has been disclosed, respectively, in the specifications of Japanese Patent Application Laid-Open No. 04-10940, Japanese Patent Application Laid-Open No. 04-10941, Japanese Patent Application Laid-Open No. 04-10942, Japanese Patent Application Laid-Open No. 04-12859, and Japanese Patent Application Laid-Open No. 11-18870 that the heat generating member is arranged close to the discharge port to bring ink to the boil, and bubble thus generated communicates with the outside to minimize the instability of the volume of liquid droplet by means of negative pressure exerted at the time of bubble shrinkage, and then, high discharge energy is provided for the liquid droplet. Such known methods are excellent in discharging small liquid droplets stably. Here, however, liquid droplet is formed by allowing bubble to be communicated with the outside. Then, the shape of liquid surface may affect the shape of liquid droplet, discharge speed, and discharge direction when the bubble is communicated with the outside.

For example, if the bubble is communicated with the outside at the time of bubble growth as disclosed in the specification of Japanese Patent Application Laid-Open No. 11-188870, the liquid column that follows the discharged liquid droplet tends to be in a state of being connected with the side wall of the discharge port on one side. As a result, the cut-off and separation of the main liquid droplet is executed in a state of being displaced from the center of the discharge port, and errors occur in the direction of discharge. As a method for preventing this occurrence, it is disclosed in the aforesaid specification of the Japanese Patent Application that the bubble is communicated with the outside (atmospheric air) when it is shrunk, and then, the separation of the main liquid droplet is executed on the side near the heat generating member so as not to allow the liquid column to be connected with the side wall for the discharge of the main liquid droplet from the center of the discharge port. In this way, it is attempted the enhancement of the directional precision of discharge according to the disclosure therein.

However, in order to attempt making liquid droplet smaller still and enhancing the recording resolution, there is a need for further improvement of the precision in the direction in which liquid droplets are discharged. Also, as another problem here, there is such a case that as shown in FIGS. 9A and 9B, the center of the heat generating member 1102 arranged on the substrate 1101 and the center of the discharge port 1104 formed for the flow path formation member 1103 are displaced eventually due to the variations created in the manufacturing process, because the structure of the ink jet recording head is so minute.

The bubble has a character that it becomes a hemisphere having high central portion by the surface tension as it is grown from the flat shape immediately after boiling. As a result, the liquid surface of the bubble on the central portion thereof is closest to the interface with the outside, and the communication with the outside tends to occur easily on this portion. The central portion of bubble is identical with the center of the heat generating member 1102. Therefore, if the relative positions of the heat generating member 1102 and the discharge port 104 are displaced, the communicating position for the bubble and the outside is biased to allow the tailing end of the liquid droplet to be in a state of adhering to the wall surface of the discharge port 1104. The micro liquid droplet formed on this tailing end portion is allowed to fly at slow speed in the direction different from that of the main liquid droplet due to the viscous resistance thereof to the wall surface of the discharge port 1104. Then, as shown in FIGS. 10A and 10B, this droplet is placed at a position away from that of the main liquid droplet on a recording medium to spoil the image quality. Particularly, the liquid droplet, which is smaller than the conventional one, is easier to be affected by the viscous resistance. Moreover, the discharge direction thus displaced may exert greater influence on the image to be formed. Therefore, it is required more than ever to make arrangement so that such displacement is not easily made in the discharge direction. Here, a reference numeral 1105 designates an ink flow path, and 1106, an ink supply path.

Also, for the ink jet recording head that forms small droplets to be discharged, it is necessary to increase the frequency of liquid droplet discharges per time. As a result, the amount of electric current that runs on the heat generating member is significantly increased, and the voltage drop is intensive due to parasite resistance on the wiring portion up to the heat generating member, leading to a problem that the discharge efficiency is lowered. In order to prevent this, it is effective to adopt a method for reducing the value of electric current by increasing the resistive value of the heat generating member. For the attainment of such means, it is conceivable to increase the resistive value of the material used for the heat generating member. However, there is a limit to the increased value of resistance that may be attained by changing materials of the heat generating member. Also, when a new material is used, it is necessary to obtain a sufficient verification to ascertain whether or not there is any functional problems when it is adopted, thus making it difficult to implement this preventive means.

SUMMARY OF THE INVENTION

Now, the present invention is designed with a view to solving the problems discussed above. It is an object of the invention to provide an ink jet recording head capable of discharging comparatively small liquid droplets from the discharge ports efficiently with the enhanced precision of the discharge direction of liquid droplets to be discharged from the discharge ports, and also, to provide an ink discharge method.

In order to achieve the aforesaid object, the ink jet recording head of the present invention comprises a substrate having heat generating members provided on the surface thereof to generate bubbles in ink; a ceiling wall facing the substrate, having plural discharge ports formed therefor to discharge ink; plural partition walls for forming plural ink flow paths each communicated with each of the discharge ports for supplying ink to each of the discharge ports; and a flow path formation member provided on the surface of the substrate, ink being discharged from the discharge port by pressure exerted by the generation of the bubble. For this ink jet recording head, one of the heat generating members is provided in each of the ink flow paths, and the discharge port is arranged on the extended line extending in the normal direction from the center of the main surface of the heat generating member; non-bubbling area is provided on the center within the projected area on the surface of the substrate having the discharge port projected thereon; and bubble brought to the boil by the heat generating member pushes out ink from the discharge port by the pressure exerted by the bubble, while being communicated with the outside.

Also, the ink jet recording head of the present invention comprises a substrate having heat generating members provided on the surface thereof to generate bubbles in ink; a ceiling wall facing the substrate, having plural discharge ports formed therefor to discharge ink; plural partition walls for forming plural ink flow paths each communicated with each of the discharge ports for supplying ink to each of the discharge ports; and a flow path formation member provided on the surface of the substrate, ink being discharged from the discharge port by pressure exerted by the generation of the bubble. For this ink jet recording head, a plurality of the heat generating members is provided in each of the ink flow paths, and the discharge port is arranged on the extended line extending in the normal direction from the center of the pressure-generating area structured by the plurality of heat generating members; non-bubbling area is provided to be positioned between a plurality of the heat generating members, and the non-bubbling area is provided within the projected area on the surface of the substrate having the discharge port projected thereon; and a bubble brought to the boil by the heat generating member pushes out ink from the discharge port by the pressure exerted by the bubble, while being communicated with the outside.

With the ink jet recording head of the present invention thus structured, when the heat generating member is energized, the temperature of the heat generating member rises, and ink is heated to the boil by heat conduction. At this juncture, on the surface of non-bubbling area, the boiling temperature is not reached and no bubbling ensues. As a result, the central portion of the bubble is controlled so as not to communicate with the outside at the time of bubbling, and even if the relative positions of the center of the heat generating member and the center of the discharge port are slightly displaced, the influence that may be exerted on the discharge direction of liquid droplet is suppressed to enable the recording head to enhance the precision of the discharge direction.

Also, for the ink jet recording head of the present invention, it is preferable to make the center-to-center distance dhc between the respective two heat generating members, which are arranged to be apart from each other most among plural heat generating members, larger than the opening diameter do of the discharge port. In this manner, even if the central position of the discharge port and the central position of the pressure-generating area are slightly displaced, the liquid column of ink discharged from the discharge port is formed between the bubble generated by one heat generating member and the bubble generated by the other heat generating member. As a result, it is not allowed to be in contact with the sidewall faces of the discharge port. Then, the main ink droplet is discharged from the discharge port without any displacement in the discharge direction. Also, if the liquid column is not allowed to be in contact with the sidewall faces of the discharge port, the portion of the main liquid droplet, which is separated from the liquid column is constant, hence making it possible to stabilize the size of the dot to be formed on a recording sheet or the like by the placement of the main liquid droplet thereon.

Also, for the ink jet recording head of the present invention, it is preferable to satisfy the relations of dhc>do+2 derr where the dhc is the distance, the do is the opening diameter, and the derr is the amount of displacement, provided that the amount of displacement of the center of the discharge port to the extended line is given as derr. In this way, it is made possible to stabilize the placement position of the main liquid droplet, while placing the micro liquid droplets generated on the separated portion between the main liquid droplet and the liquid column also on the position where the main liquid droplet is placed. Thus, it becomes possible to stabilize the shape and position of the dot formed by the liquid droplets thus placed.

Also, the method of the present invention for discharging ink from an ink jet recording head, which is provided with discharge ports for discharging ink; plural ink flow paths communicated with the discharge ports for supplying ink to the discharge ports; heat generating members for generating bubbles in ink filled in the ink flow paths, the heat generating members being provided in each of the ink flow paths, and each of the discharge ports being arranged on the extended line extended in the normal direction from the center of the pressure-generating area of the heat generating member to the surface of the substrate, for discharging ink from the discharge ports by pressure exerted by generating the bubble, comprises the following step of pushing out ink from the discharge port by pressure of bubble brought to the boil by the heat generating member, while enabling the bubble to be communicated with the outside at least two locations simultaneously at the time of being communicated with the outside.

BRIEF DESCRIPTION OF THE DRAWINGS

FIG. 2A is a plane view thereof; and FIG. 2B is a cross-sectional view thereof.

FIG. 4A is a plan view thereof; and FIG. 4B is a cross-sectional view thereof.

FIG. 5A is a plan view thereof; and FIG. 5B is a cross-sectional view taken along line A—A in FIG. 5A.

FIG. 6A is a plan view thereof; FIG. 6B is a view that illustrates the arrangement of discharge port arrays; and FIG. 6C is a cross-sectional view thereof.

DESCRIPTION OF THE PREFERRED EMBODIMENTS

Next, with reference to the accompanying drawings, the description will be made of the embodiments in accordance with the present invention.

(First Embodiment)

Figure 1:
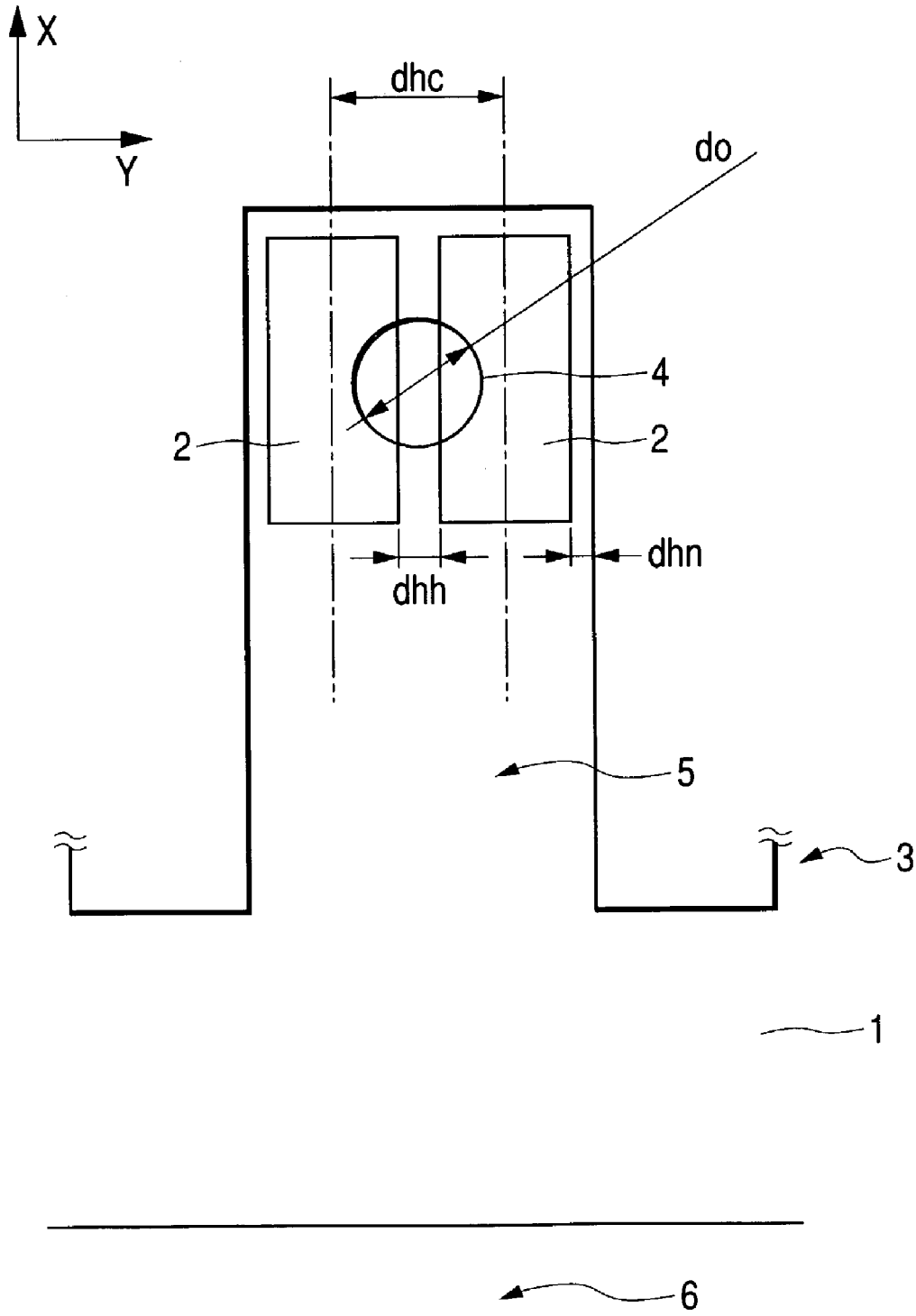
FIG. 1 is a perspective plan view that shows the relative arrangements of the ink flow path, the heat generating member, and the discharge port for an ink jet recording head in accordance with a first embodiment of the present invention.

FIG. 1 is a perspective plan view that shows the relative arrangements of the ink flow path, the heat generating member, and the discharge port for an ink jet recording head in accordance with a first embodiment of the present invention.

The ink jet recording head of the present embodiment is provided with the substrate 1 having many numbers of heat generating members 2 on the surface thereof, and the flow path formation member 3, which is arranged on the substrate 1. The flow path formation member 3 is provided with the partition walls 3*a* that divide many numbers of heat generating members 2 into two members each; and the ceiling wall 3*b* that faces the substrate 1. The partition walls 3*a* form many numbers of ink flow paths 5 that supply ink to each of the pressure generating areas formed by two heat generating members 2 thus divided. Also, for each of the ink flow paths 5, the discharge port 4 is formed for the ceiling wall 3*b* on the extended line, which is extended in the normal line direction from the center of the pressure generating area of the two heat generating members 2 to the surface of the pressure generating area. In other words, the center of opening of the discharge port 4 is positioned on the vertical line that runs through the center of the pressure generating area in the direction perpendicular to the surface of the substrate. Each of the ink flow paths 5 is commonly communicated with the ink supply path 6, and the arrangement is made so as to supply the ink, which is supplied to the ink supply path 6 from ink supply means, such as an ink tank (not shown), to each of the ink flow path 5 from the ink supply path 6.

In accordance with the present embodiment thus arranged, the pressure generating area, which is formed by two heat generating members 2, is arranged for one ink flow path 5 having one discharge port 4, respectively, and the non-bubbling area between two heat generating members 2 is position almost on the center within the projected area of the discharge port 4, which is projected on the substrate 1. Here, it is indicated that the projected area is the one obtainable by the positive projection.

In this structure, the heat generating member 2 is energized to bring ink to the boiling to form bubble. Then, when ink is pushed out from the discharge port 4, the tail portion of the ink column is connected with the non-bubbling area, and it is positioned almost in the center of the discharge port 4. Also, in this structure, when bubbles are communicated with the outside to cut off the liquid droplet, two bubbles are allowed to communicate with the outside, respectively, on the symmetrical positions almost simultaneously with the liquid droplet between them. As a result, there is no possibility that the liquid droplet is drawn onto the side where no communication is made after the liquid droplet is communicated with the outside as in the case of the conventional example. Here in the recording head, the bubble is communicated with the outside for the first time at the stage where the volume of the bubble is reduced after it has been grown to the maximum volume. With the effect thus produced, the liquid droplet is positioned in the center of the discharge port 4 in good precision to make the accuracy of the discharge direction of the liquid droplet extremely high.

Figure 2B:
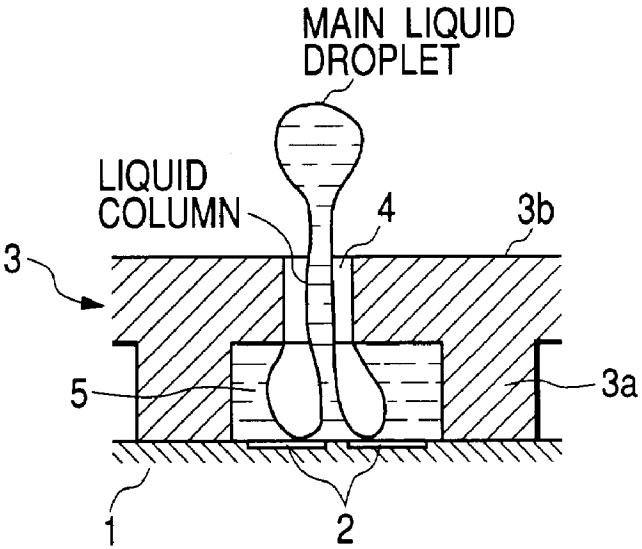
FIGS. 2A and 2B are views that illustrate the case where the central position of the discharge port is displaced from the central position of two heat generating members of the ink jet recording head shown in FIG. 1.
Figure 2A:
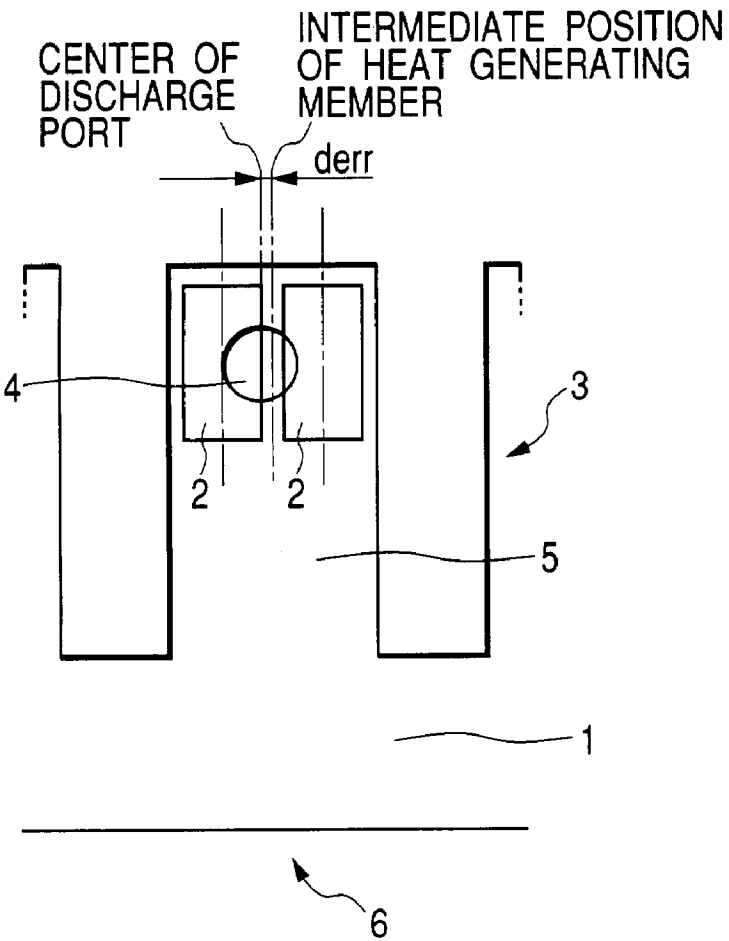

Further, in accordance with the present embodiment, the center-to-center distance dhc between two heat generating members 2 is set to be larger than the opening diameter do of the discharge port 4. Thus, even if the central position of the discharge port 4 is displaced from the central position of the heat generating member 2 as shown in FIG. 2A at the time of manufacturing the recording head, the liquid column of ink to be discharged through the discharge port 4 is formed between the bubble, which is generated by one of the heat generating members 2 of the two heat generating members 2, and the bubble, which is generated by the other heat generating member 2, and then, as shown in FIG. 2B, bubbles are communicated with the outside on both side of the liquid column, and the liquid column is not allowed to be in contact with the sidewall faces of the discharge port 4. In this way, the main liquid droplet is discharged from the discharge port 4 without any displacement in the discharge direction thereof. Also, if the liquid column is not allowed to be in contact with the sidewall faces of the discharge port 4, the portion of the liquid column that is separated from the main liquid droplet is made constant. Therefore, it is made possible to stabilize the size of the main liquid droplet, that is, the size of the dot formed by the main droplet placed on a recording sheet or the like.

Also, in the structure of the present embodiment where the discharge port 4 is arranged almost immediately above the central position of the pressure generating area formed by two heat generating member 2, the center of the discharge port 4 is displaced from the central position of each heat generating member 2 as shown in FIGS. 2A and 2B (that is, the center of the discharge port 4 is positioned on a location shifted from the location almost immediately above the center of each heat generating member 2). Consequently, the center of the bubble generated by each heat generating member 2 is displaced from the center of the discharge port 4. Thus, the portion (the central portion of the discharge port 4) of the liquid surface formed by ink in the ink flow path 5, which is closest to the interface with the outside, is separated from the portion where the bubble has been grown to the maximum (the portion almost immediately above the center of each heat generating member 2). As a result, the timing at which the bubble is communicated with the outside is deterred more than the timing in the case where the center of the heat generating member 2 is identical to the center of the discharge port 4. Therefore, as disclosed in the specification of Japanese Patent Application Laid-Open No. 11-188870, it becomes easier to provide the state of the atmospheric communication in the ink flow path 5.

If such state of atmospheric communication can be formed in the ink flow path 5, it becomes possible to form the liquid column that extends from a portion between two heat generating members 2 through the discharge port 4 as shown in FIG. 2B. In this way, the discharge direction of the main liquid droplet can be regulated within a predetermined range, hence making it possible to stabilize the discharge direction of the main liquid droplet still more.

As one example of the present embodiment, the opening diameter do of the discharge port 4 is set to be 11 μm; the width of each heat generating member 2, 12 μm; the length, 27 μm; the arrangement gap dhh between two heat generating members 2 themselves, 3 μm; and the center-to-center distance dhc of the two heat generating members 2, 14 μm. Also, the height of the ink flow path 5 is set to be 13 μm, and the thickness of the flow path formation member 3 (that is, the width between the surface with which the substrate 1 is in contact, and the surface to which the discharge port 4 is open) is set to be 25 μm.

The ink jet head thus structured is arranged so as to place the surface of the recording head having discharge ports 4 open thereto at a position away from a recording sheet (not shown) by 2 mm, and while scanning is made at a speed of 15 inches (approximately 38 cm)/second, electric-current pulse of 0.9 μs is applied to the heat generating member 2 for discharging liquid droplet to a recording sheet. This operation is carried out for each of several ink jet recording heads having the different amounts of relatively positional displacement derr between the central position of the pressure-generating area formed by two heat generating members 2 and the central position of the discharge port 4.

Figure 3:
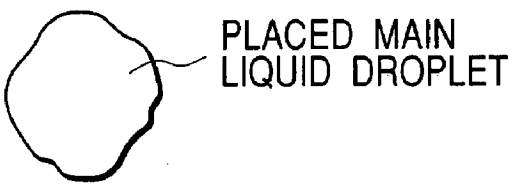
FIG. 3 is a view that shows the shape of dot formed by the liquid droplet discharged from the ink jet recording head represented in FIG. 1.

Then, from the liquid droplet placed on the recording sheet, an analysis is made for the relations between each of the amounts of relatively positional displacement derr between the central position of the pressure-generating area formed by two heat generating members 2, and the central position of the discharge port 4, and each of the dot shapes of the liquid droplet placed on the recording sheet, with the result that if the amount of positional displacement derr is up 2 μm, the liquid droplet placed on the recording sheet shows a good dot shape as shown in FIG. 3 without satellite dots formed by micro liquid droplets that take place on the portion where the main liquid droplet and the liquid column are separated. There is almost no fluctuation in the discharge direction, either. However, if the amount of positional displacement derr exceeds 2 μm, the satellite dots are being separated from the main liquid droplet gradually as the amount of positional displacement derr becomes larger, and further, the positional variation becomes greater for the liquid droplet placed on the recording sheet.

From this fact, it is found preferable to set the center-to-center distance dhc between two heat generating members 2 to be larger than the opening diameter do of the discharge port 4+(the positional displacement derr×2).

Further, if the non-heat generating area, which is formed between the adjacent heat generating members 2, is too large, the bubbles remaining to reside in ink are stagnated on this area, and such remaining bubbles absorb the discharge pressure generated at the time of bubbling. In order to prevent this, it is preferable to make the gap dhh between two heat generating members 2 themselves, which serves as the non-heat generating portion, less than two times the gap dhn between the edge adjacent to the partition wall 3*a* of each heat generating member 2, and the partition wall 3*a*. More specifically, it is preferable to make the dhh 4 μm or less if the dhn is approximately 2 μm.

Figure 9B:
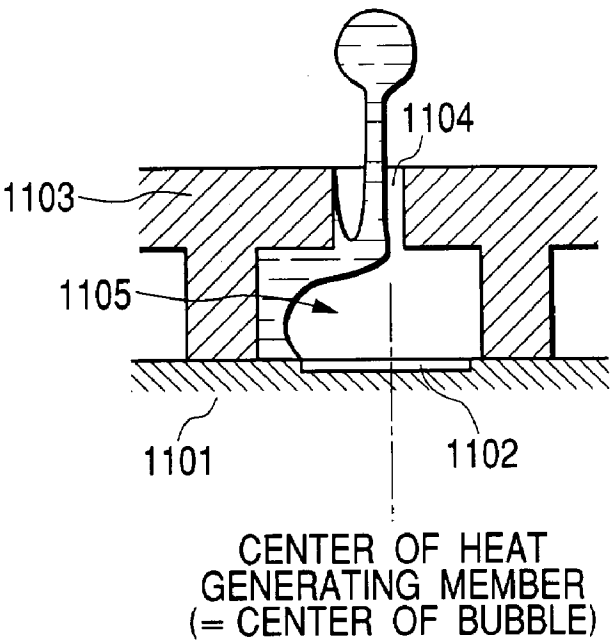
FIGS. 9A and 9B are perspective plan views that illustrate the relative arrangements of ink flow path, the heat generating member, and the discharge port for the conventional ink jet recording head.
Figure 9A:
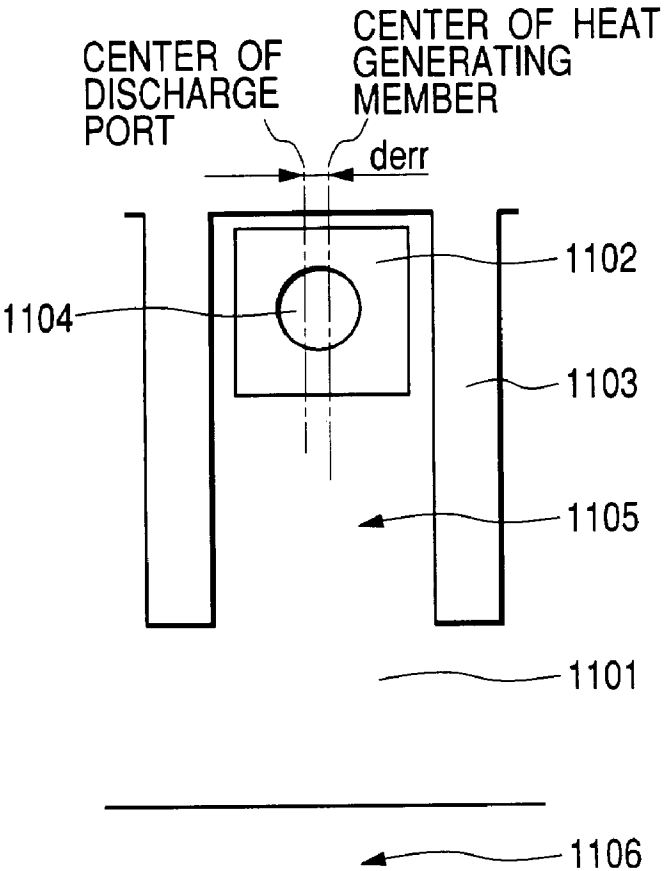
Figure 10B:
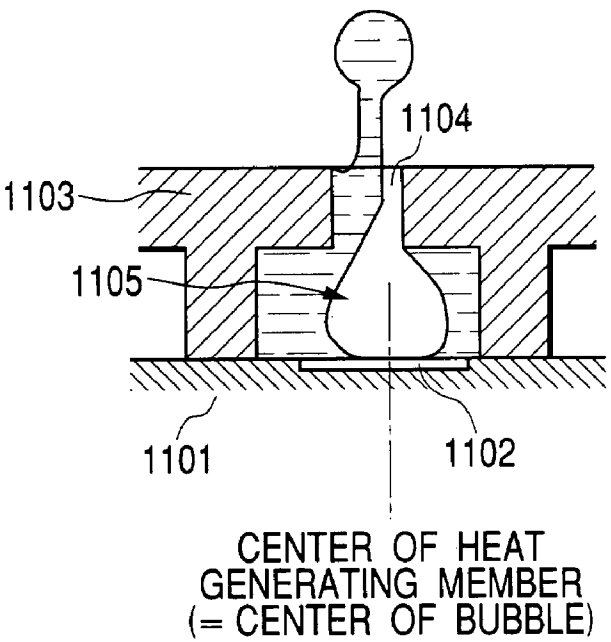
FIGS. 10A and 10B are views that illustrate the dot shape formed by liquid droplet discharged from the conventional ink jet recording head.
Figure 10A:
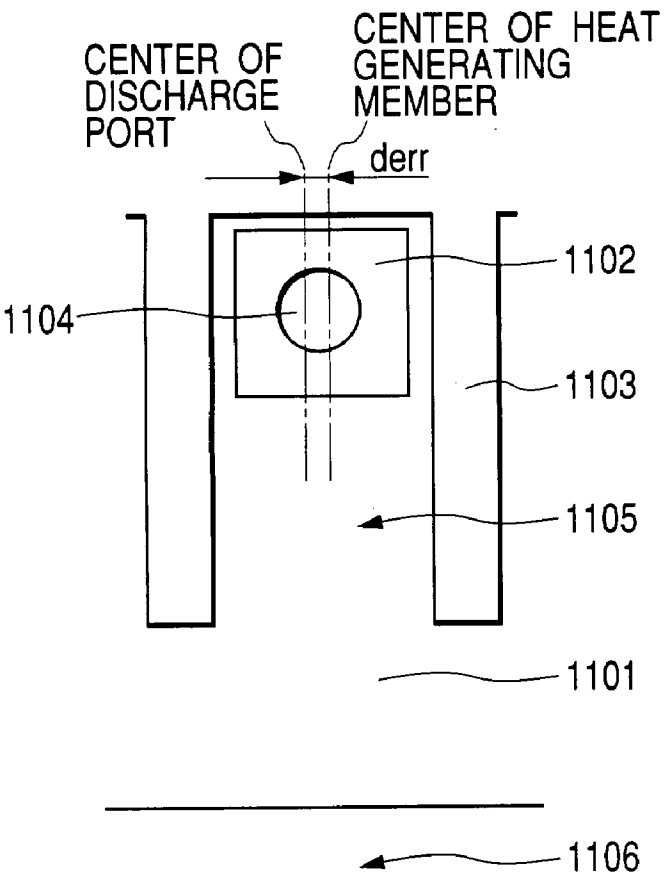

Also, for the present embodiment, the structure is arranged to connect the two heat generating members 2, which are formed in the thin and long shape as described above, by wiring electrically in series. In this way, it is made possible to obtain a higher resistive value, which is 3.5 times to 6 times the conventional heat generating member having a comparatively large area as shown in FIGS. 9A and 9B. Thus, the required value of electric current can be made approximately ½ of the conventional one. Therefore, even when a higher speed discharge operation is attempted along with the adoption of smaller liquid droplets to be discharged, it becomes possible to suppress the increase of amount of electric current running on the heat generating members 2. Also, it is possible to suppress the heat generation and voltage drop due to the resistance of the wiring portion up to the heat generating member 2, as well as the induction noises that may take place by a large electric current running through the wiring portion.

In this respect, with a view to preventing the heat generating member from the electrical requirements for suppressing the increase of the amount of electric current when it is attempted to speed up the discharge operations along with the provision of smaller liquid droplets to be discharged or preventing it from receiving the cavitation shocks, which occur following the destruction of the boiling bubble due to the negative pressure exerted therein, the proposals have been already made to divide the heat generating members and arrange them. However, for the present embodiment, the optimal relations of arrangements have been studied with respect to the heat generating members 2, ink flow paths 5, and discharge ports 4 from the view point of the influences that may be exerted by plural heat generating members 2 arranged in one ink flow path 5, that is, from the view point of the influences that may be exerted by plural pressure generating sources on the discharge performance. The example of the kind has never been proposed up to the present.

(Second Embodiment)

Figure 4B:
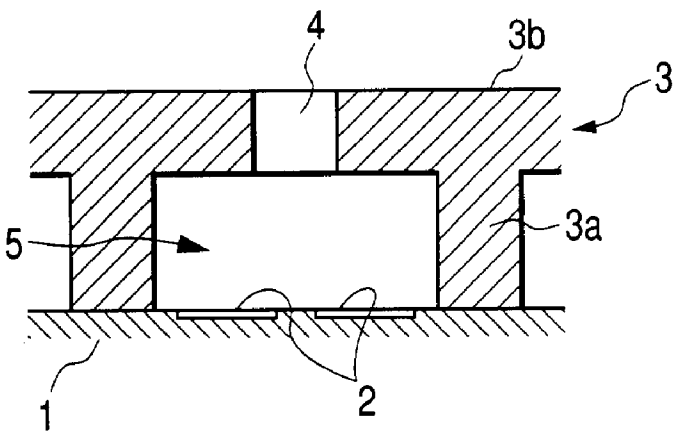
FIGS. 4A and 4B are views that illustrate the relative arrangements of the ink flow path, the heat generating member, and the discharge port for an ink jet recording head in accordance with a second embodiment of the present invention.
Figure 4A:
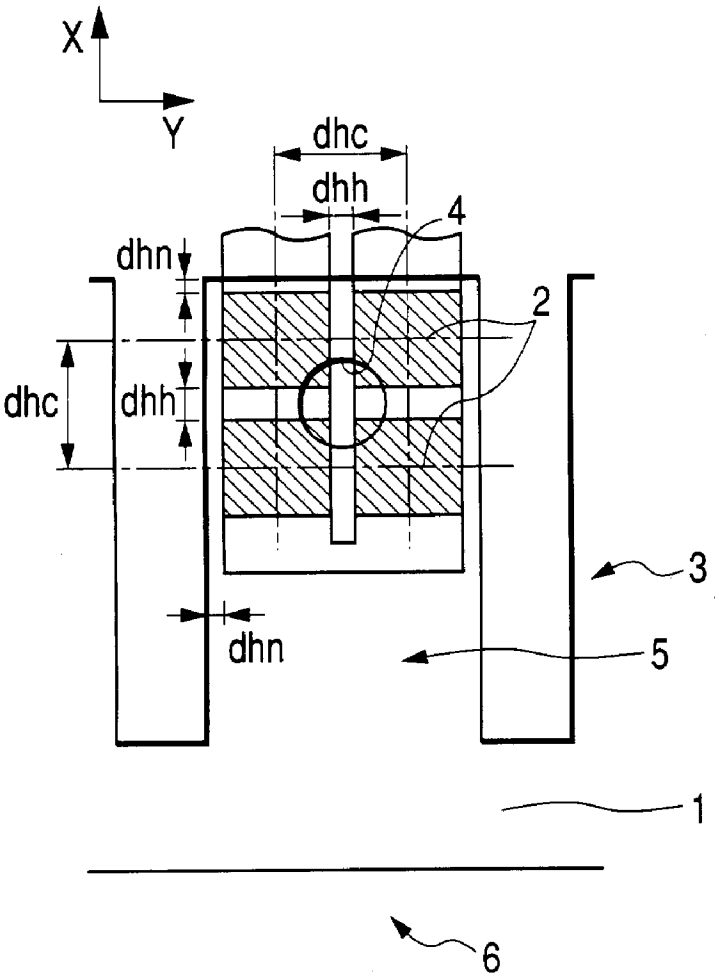

FIGS. 4A and 4B are views that illustrate the relative arrangements of the ink flow path, the heat generating member, and the discharge port for an ink jet recording head in accordance with a second embodiment of the present invention. FIG. 4A is a plan view thereof; and FIG. 4B is a cross-sectional view thereof.

As shown in FIG. 4A, the ink jet recording head of the present embodiment is particularly provided with the pressure-generating area formed by one set of four heat generating members 2 in one ink flow path 5. With the assumption that these heat generating members 2 define the ink flow in ink flow path 5 as X direction toward the heat generating member 2 from the ink supply path 6 side, and the direction orthogonal to this X direction as Y direction, two of them are arranged in the X direction, and two of them in the Y direction, respectively. Also, these heat generating members 2 are electrically connected in series. The discharge port 4 is arranged on the extended line that extends in the normal direction from the center of the pressure-generating area formed by four heat generating members 2 to the surface of the pressure-generating area.

For the present embodiment, too, the center-to-center distance dhc between the adjacent heat generating members 2 themselves is set to be larger than the opening diameter do of the discharge port 4+(amount of positional displacement derr×2), and the gap dhh between the heat generating members 2 themselves is set to be less than two times the gap dhn between the edge adjacent to the partition wall 3*a* of each heat generating member 2 and the partition wall 3*a*.

In accordance with the present embodiment, even if the central position of the discharge port 4 should be displaced from the central position of the pressure-generating area not only in the Y direction, but also, in the X direction, the liquid column is not allowed to be in contact with the side wall faces of the discharge port 4. Therefore, it is made possible to discharge the main liquid droplet from the discharge port 4 without any displacement in the discharge direction, and to stabilize the size of the main droplet, that is, the size of the dot formed by the main liquid droplet placed on a recording sheet or the like as well.

Now, whereas the first embodiment is structured to demonstrate the effect thereof when the central position of the discharge port 4 is displaced in the Y direction from the central position of the pressure-generating area formed by two heat generating members 2, the present embodiment is structured to demonstrate the effect thereof when such displacement takes place not only in the Y direction, but also, in the X direction. Therefore, it is made possible to stabilize the discharges of liquid droplets still more.

In this respect, the ink jet recording head of the present invention is not only applicable to the cases as in the first and second embodiments where two or four heat generating members 2 are arranged in one ink flow path 5, but also, it is applicable to all the cases where two or more numbers of heat generating members are arranged in one ink flow path 5.

In this case, the aforesaid distance dhc is defined as "a center-to-center distance between each two heat generating members arranged to be apart from each other most among the plural heat generating members". Also, the aforesaid gap dhh is defined as "a gap between the adjacent two heat generating members themselves apart from each other most among the plural heat generating members in the direction across the partition walls that partition the ink flow paths".

(Third Embodiment)

Figure 5B:
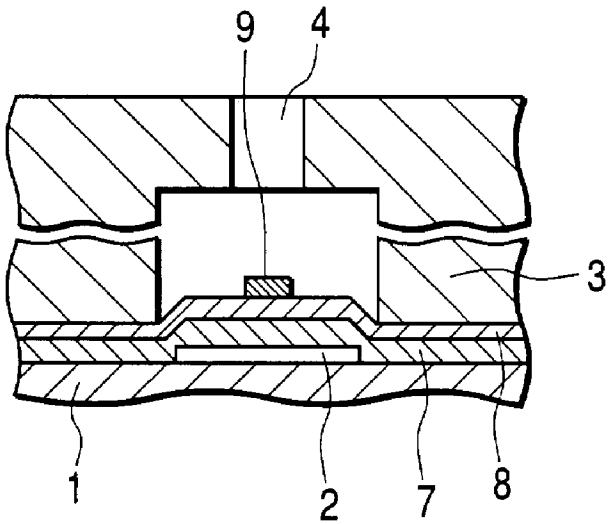
FIGS. 5A and 5B are views that illustrate the relative arrangements of the ink flow path, the heat generating member, the discharge port, and the non-heat generating area for an ink jet recording head in accordance with a third embodiment of the present invention.
Figure 5A:
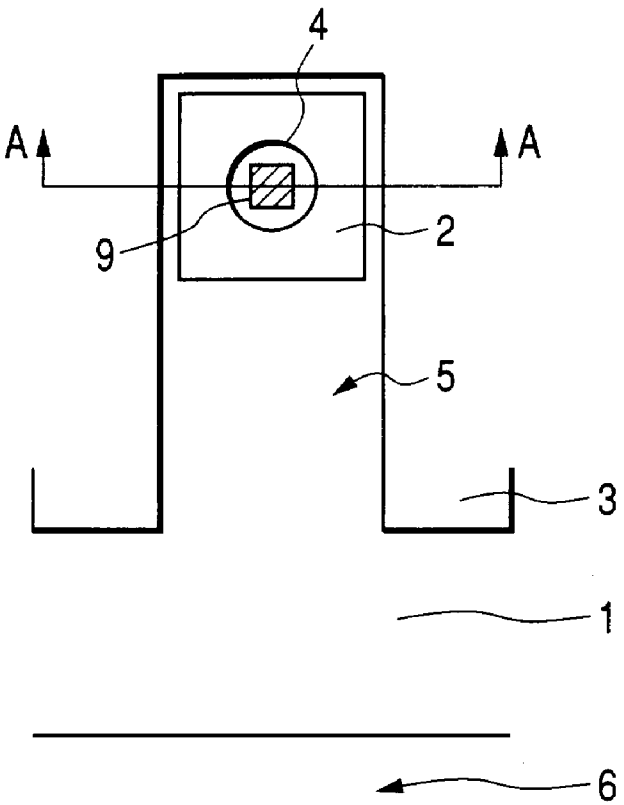

FIGS. 5A and 5B are views that illustrate the relative arrangements of the ink flow path, the heat generating member, the discharge port, and the non-heat generating area for an ink jet recording head in accordance with a third embodiment of the present invention.

The ink jet head of the third embodiment is different from the embodiments described above in that only one heat generating member 2 in the square form is arranged in one ink flow path 5. All other structures of the recording head of the present embodiment are almost the same as those of the first embodiment. For convenience' sake, therefore, the same reference marks are applied to the same members, and the description thereof will be omitted.

For the present embodiment, each of the heat generating members 2 is in a square of 26 μm wide×26 μm long, and the opening diameter do of the discharge port 4 is 16 μm. Also, as shown in FIGS. 5A and 5B, first and second protection films 7 and 8, and a non-bubble area formation film 9 are laminated, respectively on each of the heat generating members 2

The first protection film 7 adjacent to the heat generating member 2 is an insulation layer, and preferably, such film is an inorganic film represented by silicon nitride, silicon oxide, or the like. It is preferable to make the film thickness of the first protection film 7 from 1000 to 5000 Å in order to secure insulation. Preferably, a second protection film 8 is formed using a metallic film, such as tantalum having a comparatively high resistance to ink for the protection of the first protection film 7 from ink. It is usually practiced to make the film thickness of the second protection film 8 substantially the same as that of the first protection film 7. For the present embodiment, it is formed in a thickness of 3000 Å.

The non-bubble area formation film 9 is formed on the second protection film 8, which is in a size only to cover partly the center of the heat generating member 2. For the present embodiment, it is formed in a square of 4 μm×4 μm. Here, a material having lower heat-conduction than that of the second protection film 8 is adopted to form the non-bubble area formation film 9 or it is necessary to make the film thickness thereof larger than that of the second protection film 8. Therefore, as the non-bubble area formation film 9, a film formed by silicon oxide in a thickness of 3000 Å for the present embodiment.

When the heat generating member 2 of the recording head is energized, the temperature of the heat generating member 2 rises, and heat is given to ink for boiling through the surface of the second protection film 8. At this juncture, on the surface of the non-bubble area, no bubbling occurs, because it has lower heat conductivity to the second protection film 8, and the temperature thereof does not reach the boiling temperature. Consequently, the communication with the outside is suppressed on the central portion of the bubble at the time of bubbling. Then, even if a slight displacement occurs in the relative positions of the center of the heat generating member 2 and the center of the discharge port 4, it becomes possible for the recording head to suppress the influence that may be exerted on liquid droplets with respect to the discharge direction thereof. In this manner, it is made possible for a single heat generating member 2 to obtain the high precision of discharge direction as in the case of the first embodiment.

Here, for the present embodiment, the material, which is different from the one used for the second protection film 8, is used for the non-bubble area formation film 9 in order to obtain the non-bubble area. However, it may be possible to use the same material of the second protection film for the non-bubble area formation film by making the film thickness thereof partly larger. When the film thickness is partly made larger for the thin film like this, it is possible to attain the purpose with ease by giving half etching treatment to the portion other than the non-bubble area by means of dry etching process or the like, for example.

(Fourth Embodiment)

Figure 6A:
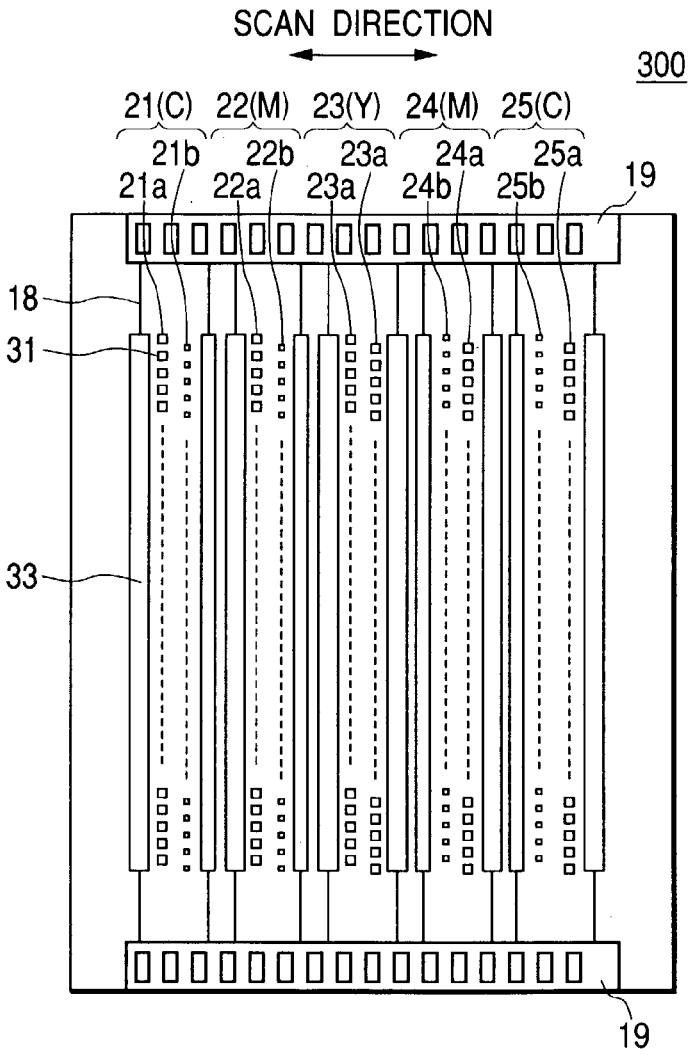
FIGS. 6A, 6B, and 6C are views that schematically illustrate the principal part of an ink jet recording head in accordance with a fourth embodiment of the present invention.
Figure 6B:
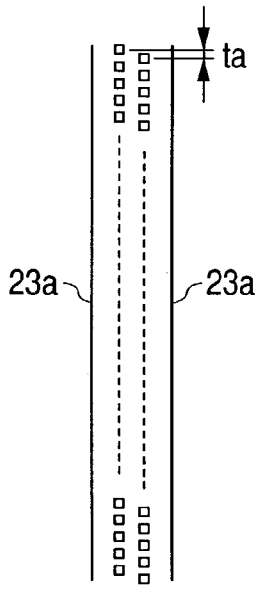
Figure 6C:
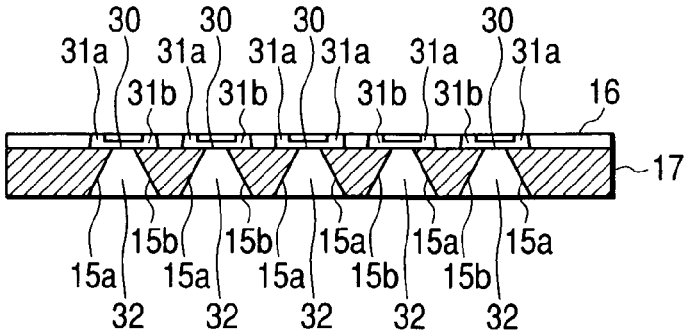

FIGS. 6A, 6B, and 6C are views that schematically illustrate the principal part of an ink jet recording head in accordance with a fourth embodiment of the present invention; FIG. 6A is a plan view thereof; FIG. 6B is a view that illustrates the arrangement of discharge port arrays; and FIG. 6C is a cross-sectional view thereof.

As shown in FIG. 6C, the recording head 300 of the present embodiment is provided with a substrate 17 that contains the heat generating members 15*a* and 15*b* each serving as energy converting element; and an orifice plate 16 that forms the discharge ports 31 and the ink flow paths 30 that supply ink to the discharge ports 31.

The substrate 17 is formed by silicon mono-crystal of plane orientation <100> in accordance with the present embodiment. On the upper surface thereof (the surface connected with the orifice plate 6), there are formed using the semiconductor process, the heat generating resistive elements 15*a* and 15*b*; a driving circuit 33 formed by driving transistors and others for driving these heat generating resistive elements 15*a* and 15*b*; the contact pad 19 connected with a wiring plate to be described later; and the wiring 18, which connects the driving circuit 33 and the contact pad 19, among some others. Also, for the substrate 17, five penetrated openings, which are formed by use of anisotropic etching, are arranged on the area other than the area where the aforesaid driving circuit 33, heat generating resistive elements 15*a* and 15*b*, wiring 18, and contact pad 19. These penetrated openings form the ink supply ports 32 to supply liquid respectively to the discharge port arrays 21*a*, 21*b*, 22*a*, 22*b*, 23*a*, 23*b*, 24*a*, 24*b*, and 25*a* and 25*b*, which will be described later. In this respect, FIG. 6A schematically shows the state where a substantially transparent orifice plate 16 is installed on the substrate 17 without the representation of the aforesaid ink supply ports 32.

Each of the discharge port arrays 21*a*, 21*b*, 22*a*, 22*b*, 23*a*, 23*b*, 24*a*, 24*b*, and 25*a* and 25*b* forms a pair of those communicated with each ink supply port 32, respectively, and forms 5 pairs of discharge port arrays 21, 22, 23, 24, and 25. Of these pairs of discharge port arrays, ink of cyan (C) color is supplied to a pair of discharge port arrays 21 and 25, ink of magenta (M) color is supplied to a pair of discharge port arrays 22 and 24, and ink of yellow (Y) color is supplied to a pair of discharge port arrays 23. Also, for each pair of discharge port arrays, adjacent discharge port arrays are displaced from each other by an amount ta in the arrangement direction as shown in FIG. 6B with respect to a pair of discharge port arrays 23, for example.

The orifice plate 16 provided for the substrate 17 is formed by photosensitive epoxy rein, and through the processes disclosed in the specification of Japanese Patent Application Laid-Open No. 62-264957, the discharge ports 31 and liquid flow paths 30 are formed corresponding to the aforesaid heat generating resistive elements 15*a* and 15*b*. Here, as disclosed in the specification of Japanese Patent Application Laid-Open No. 09-11479, the orifice plate 16, which is provided with the discharge ports 31 and the liquid flow paths 30, is formed after the formation of silicon oxide film or silicon nitride film (not shown) on the silicon substrate 17, and then, the aforesaid recording head is manufactured by removing the silicon oxide film or silicon nitride film on the portions that form the ink supply port 32 by means of the aforesaid anisotropic etching. This is desirable when manufacturing a recording head in high precision at lower costs.

Figure 7A:
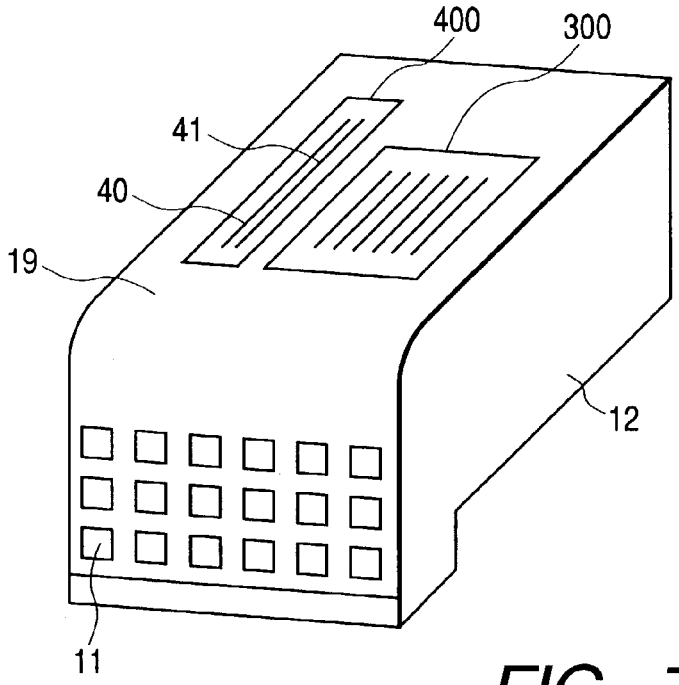
FIGS. 7A, 7B and 7C are views that illustrate one example of the ink jet recording cartridge, which is provided with the ink jet recording head represented in FIGS. 6A to 6C.
Figure 7C:
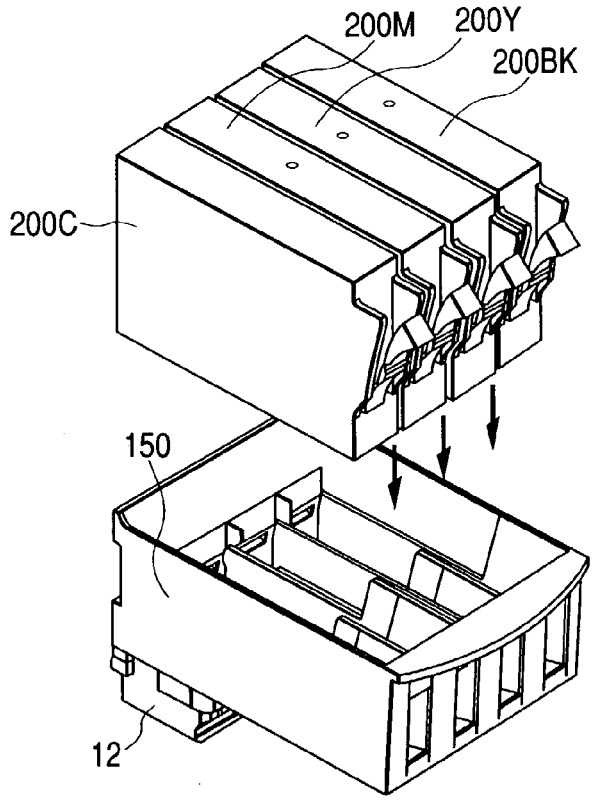
Figure 7B:
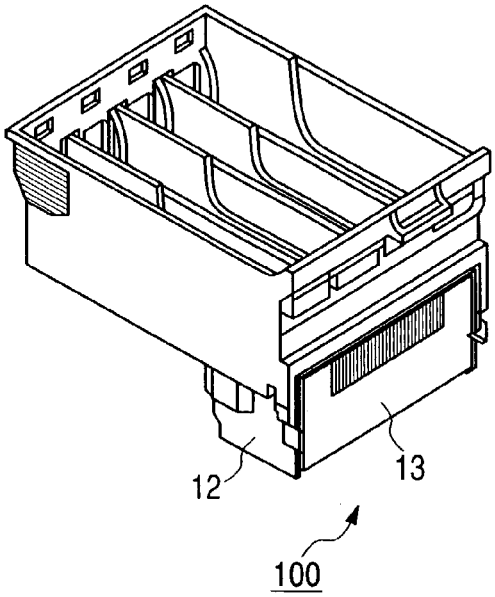

FIGS. 7A 7B, and 7C are views that illustrate one example of the ink jet recording cartridge provided with the ink jet recording head represented in FIGS. 6A to 6C.

The recording head 300, which is provided with the substrate 17 and the orifice plate 16 described above, performs recording by discharging liquid, such as ink, from the discharge ports 31 by the utilization of bubbling pressure exerted by boiling generated by the application of thermal energy using the heat generating resistive elements 15*a* and 15*b*. As shown in FIG. 7A, the recording head 300 is fixed to the ink flow path formation member 12 that supplies ink to the ink supply ports 32, and the contact pad 19 is connected with the wiring plate 13. Then, driving signals and others can be received from the recording apparatus when the electrically connecting portion 11 provided for the wiring plate 13 is connected with the electrically connecting portion of the recording apparatus to be described later.

To the ink flow path formation member 12, the recording head 400, which is provided with the discharge port arrays 40 and 41 for discharging black ink (Bk), is fixed besides the recording head 300 capable of discharging each ink of Y, M, C colors as described above. These heads are combined to form a recording head cartridge 100 capable of discharging ink of four colors.

FIGS. 7B and 7C are perspective views that illustrate one example of the recording head cartridge 100 provided with the aforesaid recording head 300. As shown in FIG. 7C, the recording head cartridge 100 is provided with a tank holder 150 for holding the ink tanks 200Y, 200M, 200C, and 200Bk, which supply ink to the ink flow path formation member 12.

Again referring to FIGS. 6A to 6C, 10 columns of discharge port arrays are structured for the recording head 300 of the present embodiment, and 5 slit type ink supply ports 32 are provided for the substrate 17. Then, one column of each discharge port array of each pair of discharge port arrays is arranged, respectively, for both sides along the ink supply port 32 in the longitudinal direction.

The ink, which is induced into each of the ink supply ports 32 from each of the ink tanks 200Y to 200 Bk through the ink flow path formation member 12, is supplied to the surface side of the substrate 17 from the backside thereof, and induced into each of the discharge ports 31 by way of each of the ink flow paths 30 formed on the surface of the substrate 17. Then, the ink is discharged from the discharge port 31 by means of the bubbling pressure exerted by the heat generating resistive elements 15*a* and 15 *b*provided near each of the discharge ports 31 on the surface of the substrate 17 to give heat and boiling.

As described above, ink of cyan (C), magenta (M), yellow (Y), magenta (M), and cyan (C) are supplied, respectively, to each of the ink supply ports 32 in that order from the left-hand side in FIG. 6B. Therefore, four columns of discharge port arrays 21*a*, 21*b*, 25*a*, and 25*b* discharge cyan ink; four columns of discharge port arrays 22*a*, 22*b*, 24*a*, and 24*b* discharge magenta ink; and two columns of discharge port arrays 23*a* and 23*b* discharge yellow ink. When the recording head 300 scans in the left direction indicated by a double-headed arrow in FIG. 6A, the pairs of discharge port arrays 21, 22, and 23 discharge ink for recording, and when it scans in the right direction, the pairs of discharge port arrays 25, 24, 23 discharge ink for recording. With the structure thus arranged to supply ink of each color to each of the discharge port arrays, the superposing order of ink color is made equal on a recording medium both at the time of traveling in the forward direction and at the time of traveling in the backward direction (bi-directional recording) even when the recording head 300 performs recording while traveling in either directions indicated by the double-headed arrow in FIG. 6A. As a result, it is made possible to recording images in high quality at high speed without creating any unevenness in colors.

For the recording head 300 of the present embodiment, the pairs of discharge port arrays 21 and 25, which discharge cyan ink, and discharge port arrays 22 and 24, which discharge magenta ink are formed, respectively, by two columns of discharge port arrays having discharge ports each of which discharges liquid droplets of different sizes from each other. In other words, the pairs of discharge port arrays 21 and 25 that discharge cyan ink are formed by the discharge port arrays 21*a* and 25*a* that discharge comparatively large liquid droplets, and by the discharge port arrays 21*b* and 25*b* that discharge comparatively small liquid droplets, respectively. The pairs of discharge port arrays 22 and 24 that discharge magenta ink are formed by the discharge port arrays 22*a* and 24*a* that discharge comparatively large liquid droplets, and by the discharge port arrays 22*b* and 24*b* that discharge comparatively small liquid droplets, respectively.

Then, correspondingly, for the discharge port arrays 21*a*, 22*a*, 23*a*, and 24*a* that discharge comparatively large liquid droplets, a comparatively large heat generating resistive element 15*a* is provided in each of the discharge ports, and for the discharge port arrays 21*b*, 22*b*, 23*b*, and 24*b* that discharge comparatively small liquid droplets, a comparatively small heat generating resistive element 15*b* is provided in each of the discharge ports.

As described earlier, when recording is made using a recording head of the kind, the recording head scans at first in the direction X for the execution of recording of one-line portion. Then, in continuation, after the scanning of the recording medium in the direction Y for one-line portion, the recording head scans reversely in the direction X for the execution of recording of one line portion. These scans are repeated in that order to form images of one-page portion. Therefore, if the discharge direction of liquid droplets is inclined in the direction Y, the distance between each of these inclinatorily discharged droplets and each of liquid droplets discharged from each of the adjacent discharge ports to those discharge ports that have discharges such inclined liquid droplets is caused to be uneven, thus making it easier to create stripes on the recording medium in parallel to the scanning direction of the recording head. In the structure of the present embodiment where two heat generating resistive elements 2 are arranged symmetrically in the direction Y centering on the discharge port 4, respectively, the precision of discharge direction becomes higher in the direction Y than that of the direction X, which presents advantages in enhancing the quality of recorded images. Also, as understandable from the representation of FIG. 1, the ink flow path 5 extends in the direction X. For example, therefore, if two heat generating resistive elements are arranged symmetrically for the discharge port in the direction X, respectively, the profile of the bubble growth becomes different in the bubble generated by the heat generating resistive element on the side nearer to the flow path and the bubble generated by the heat generating resistive element on the said away from the flow path. As a result, the timing at which the bubble is communicated with the outside is made slightly different, too. Therefore, it is desirable to arrange two heat generating resistive elements in the direction Y, and the precision of the discharge direction can be improved slightly.

With the structure thus arranged, it becomes possible to record images in high quality, while maintaining the high-speed of the recording operation with the use of different discharge ports for recording, such as to execute the recording of the portion that needs highly precise images to be recorded using the discharge ports 31*b* that discharge comparatively small liquid droplets, and to execute recording on other portions using the discharge ports 31*a* that discharge comparatively large liquid droplets. In order to attain the high-quality image formation and the high-speed recording in a better balance, it is preferable to set a ratio of 2:1 or more between the amount (size) of the liquid droplets discharged from the discharge port arrays 21*a*, 22*a*, 24*a*, and 25*a* that discharge comparatively large liquid droplets and the amount (size) of the liquid droplets discharged from the discharge port arrays 21*b*, 22*b*, 24*b*, and 25*b*.

Also, the pair of discharge port arrays 23 that discharge yellow ink is formed by two columns of discharge port arrays 23*a* that discharge comparatively large liquid droplets, and in each of the discharge ports of each discharge port array 23*a*, there are arranged the comparatively large heat generating resistive elements 15*a*, each size of which is the same as the one used for the discharge port arrays 21*a*, 22*a*, 24*a*, and 25*a*.

For the present embodiment, each of the discharge ports 31*a* of the discharge port arrays 21*a* to 25*a* that discharge comparatively large liquid droplets has a diameter of 19.5 μm in the ink flow direction in the ink flow path 30, and the diameter thereof in the direction orthogonal thereto is formed to be elliptic of 12 μm. Then, each of the discharge ports 31*b* of the discharge port arrays 21*b* to 25*b* that discharge comparatively small liquid droplets is formed to be elliptic of 11 μm. In the ink flow path 30 where the discharge port 31*a* that discharges comparatively large liquid droplets, two heat generating resistive elements 15*a* each having 12 μm wide and 28 μm long are arranged with a gap of 4 μm with each other in the direction Y, and the center-to-center distance of 16 μm. On the other hand, in the ink flow path 30 where the discharge port 31*b* that discharges comparatively small liquid droplets, two heat generating resistive elements 15*b* each having 12 μm wide and 27 μm long are arranged with a gap of 3 μm with each other in the direction Y, and the center-to-center distance of 15 μm. In this respect, the thickness of the flow path formation member (orifice plate 16) is 25 μm, and the height of the flow path (the height from the surface of the substrate to the opening surface of the discharge port) is commonly formed to be 13 μm both for the discharge ports 31*a* and 31*b*.

The recording head 300 thus structured is able to discharge liquid droplets of approximately 5 pl each from each discharge port 31*a* that discharges comparatively large liquid droplets, and liquid droplets of approximately 2.5 pl each from each discharge port 31*b* that discharges comparatively small liquid droplets, thus making high-quality images obtainable with an excellent dot shape and placement precision.

In this respect, the description has been made of the optimal structure for the present embodiment. However, the kinds of ink to be supplied from each of the ink supply ports 32, the numbers of ink supply ports 32 and discharge port arrays are not necessarily limited to the aforesaid structure. These are changeable appropriately.

(Other Embodiments)

Figure 8:
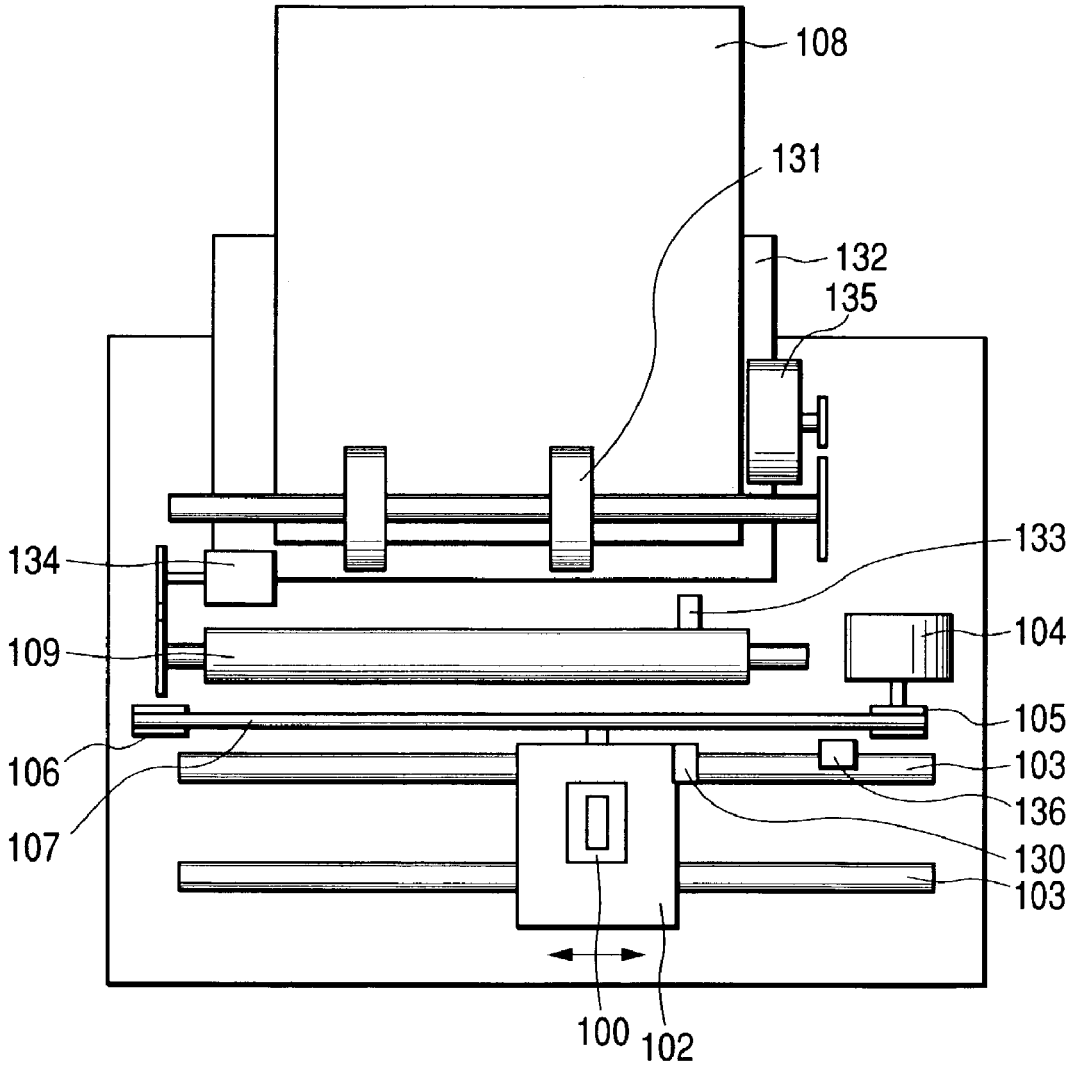
FIG. 8 is a view that schematically shows one example of a recording apparatus capable of mounting the ink jet recording head of the present invention.

Lastly, with reference to FIG. 8, the description will be made of the recording apparatus capable of mounting the ink jet head or the recording head cartridge that has been described in each of the aforesaid embodiments. FIG. 8 is a view that schematically shows the structure of one example of the recording apparatus, which is capable of mounting an ink jet recording head of the present invention.

As shown in FIG. 8, the recording head cartridge 100 is detachably mounted on the carriage 102. The recording head cartridge 100 is provided with a recording head unit and ink tanks, and also, with the connector (not shown) that transmits and receives signals and the like to drive the head unit.

The recording head cartridge 100 is positioned and installed exchangeably on the carriage 102. For the carriage 102, an electric connecting portion is provided to transmit driving signals and others to each head units through the aforesaid connector.

Along the guide shaft 103 installed on the apparatus main body and extended in the main scan direction (in the direction indicated by a double-headed arrow in FIG. 8), the carriage 102 is supported and guided to be able to reciprocate. Then, a main-scan motor 104 drives the carriage 102 through a motor pulley 105, a driven pulley 106, a timing belt 107, and others, while the position and movement of the carriage is being controlled. Also, on the carriage 102, a home position sensor 130 is installed. When the home position sensor 130 on the carriage 102 detects that it has passed the position of the sealing plate 136, the carriage 102 is known to be in the home position.

A recording medium 108, such as a recording sheet, thin plastic sheet, is fed from an automatic sheet feeder 132 one by one with the rotation of a pick-up roller 131 driven by a sheet feed motor 135 through gears. The recording medium 108 is conveyed (sub-scanned) further by the rotation of a carrier roller 109 to the position (printing portion) that faces the discharge port surface of the head cartridge 100. The carrier roller 109 rotates when an LF motor 134 is driven and the driving power thereof is transmitted through gears. At that time, with the passage of the leading end of the recording medium 108 at a paper end sensor 133 in the conveying direction, it is determined whether or not the recording medium 108 is actually fed, and then, the head position thereof is established. Also, the paper end sensor 133 detects the actual position of the trailing end of the recording medium 108, and it is also used for working out the current recording position ultimately in accordance with the actual rear end thereof thus detected.

In this respect, the backside of the recording medium 108 is supported by a platen (not shown) in order to provide the flat printing surface thereof in the printing unit. Then, the recording head cartridge 100, which is mounted on the carriage 102, is held to enable the discharge surface thereof to be extruded downward from the carriage 102 to be in parallel to the recording medium 108.

The recording head cartridge 100 is mounted on the carriage 102 so that the arrangement direction of the discharge port arrays is in the direction intersecting the scanning direction of the carriage 102, thus performing recording on the recording medium 108 with the repetition of the operation that enables the recording head cartridge 100 to scan, while discharging ink from the discharge port arrays, and the operation that enables the recording medium 108 to be conveyed by use of the carrier roller 109 in the sub-scan direction by the recording width of one-scanning portion.

What is claimed is:

1. An ink jet recording head comprising:

a substrate having heat generating members provided on a surface thereof to generate bubbles in ink;

a ceiling wall facing said substrate, having plural discharge ports formed therefor to discharge ink;

plural partition walls for forming plural ink flow paths communicating with said discharge ports, respectively, for supplying ink to said discharge ports; and a flow path formation member provided on the surface of said substrate, ink being discharged from said discharge ports by pressure exerted by the generation of the bubbles, wherein for each of said ink flow paths a plurality of said heat generating members, including two rectangular heat generating members electrically connected in series, is provided therein, and said discharge port is arranged on an extended line extending in a normal direction from a center of a pressure-generating area structured by said plurality of heat generating members, a non-bubbling area is provided to be positioned between said plurality of said heat generating members, and said non-bubbling area is provided within a projected area on the surface of said substrate having said discharge port projected thereon, a bubble caused by boiling ink by said heat generating members communicates with the outside for the first time during the stage in which the volume of the bubble is reduced after the volume of the bubble has grown to a maximum value, and portions of said two rectangular heat generating members overlap with the projected area of the discharge port projected on the surface of the substrate.

2. An ink jet recording head according to claim 1, wherein said non-bubbling area is positioned almost in a center of the projected area.

3. An ink jet recording head according to claim 1, wherein, for said substrate, an ink supply path is provided to supply ink to said ink flow paths, and the direction of ink flow from said ink supply path to said heat generating members is parallel to the direction in which said ink jet recording head travels with respect to a recording medium at the time of discharging ink, and in each of said ink flow paths, a plurality of said heat generating members is symmetrically arranged for said discharge port, with respect to said partition walls.

* * * * *

UNITED STATES PATENT AND TRADEMARK OFFICE

CERTIFICATE OF CORRECTION

PATENT NO. : 6,988,786 B2
APPLICATION NO. : 10/345977
DATED : January 24, 2006
INVENTOR(S) : Mineo Kaneko et al.

It is certified that error appears in the above-identified patent and that said Letters Patent is hereby corrected as shown below:

COLUMN 1
Line 42, “dye-staffs” should read --dye-stuffs--.

COLUMN 2
Line 44, “discharge port 104” should read --discharge port 1104--.

COLUMN 6
Line 67, “side” should read --sides--.

COLUMN 7
Line 15, “member 2” should read --members 2--.

COLUMN 8
Line 66, “view point” should read --viewpoint--.

COLUMN 9
Line 1, “view point” should read --viewpoint--.
Line 4, “the kind” should read --this kind--.

COLUMN 11
Line 65, “rein,” should read --resin,--.

COLUMN 12
Line 14, “FIGS. 7A7B,” should read --FIGS. 7A, 7B,--.
Line 60, “15 *b*provided” should read --15*b* provided--.

COLUMN 13
Line 17, “recording” should read --record--.
Line 56, “discharges” should read --discharged--.

UNITED STATES PATENT AND TRADEMARK OFFICE

CERTIFICATE OF CORRECTION

PATENT NO. : 6,988,786 B2
APPLICATION NO. : 10/345977
DATED : January 24, 2006
INVENTOR(S) : Mineo Kaneko et al.

It is certified that error appears in the above-identified patent and that said Letters Patent is hereby corrected as shown below:

COLUMN 14
Line 7, “said” should read --side--.

COLUMN 15
Line 26, “each” should read --the--, and “units” should read --unit--.

Signed and Sealed this

Twenty-second Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 6,988,786 B2
APPLICATION NO. : 10/418218
DATED : January 24, 2006
INVENTOR(S) : Mineo Kaneko et al.

It is certified that error appears in the above-identified patent and that said Letters Patent is hereby corrected as shown below:

COLUMN 1
Line 42, “dye-staffs” should read --dye-stuffs--.

COLUMN 2
Line 44, “discharge port 104” should read --discharge port 1104--.

COLUMN 6
Line 67, “side” should read --sides--.

COLUMN 7
Line 15, “member 2” should read --members 2--.

COLUMN 8
Line 66, “view point” should read --viewpoint--.

COLUMN 9
Line 1, “view point” should read --viewpoint--.
Line 4, “the kind” should read --this kind--.

COLUMN 11
Line 65, “rein,” should read --resin,--.

COLUMN 12
Line 14, “FIGS. 7A7B,” should read --FIGS. 7A, 7B,--.
Line 60, “15 *b*provided” should read --15*b* provided--.

COLUMN 13
Line 17, “recording” should read --record--.
Line 56, “discharges” should read --discharged--.

UNITED STATES PATENT AND TRADEMARK OFFICE

CERTIFICATE OF CORRECTION

PATENT NO. : 6,988,786 B2
APPLICATION NO. : 10/418218
DATED : January 24, 2006
INVENTOR(S) : Mineo Kaneko et al.

It is certified that error appears in the above-identified patent and that said Letters Patent is hereby corrected as shown below:

COLUMN 14
Line 7, "said" should read --side--.

COLUMN 15
Line 26, "each" should read --the--, and "units" should read --unit--.

This certificate supersedes Certificate of Correction issued August 22, 2006.

Signed and Sealed this

Tenth Day of October, 2006

JON W. DUDAS
*Director of the United States Patent and Trademark Office*